US006398699B1

(12) United States Patent
Yang

(10) Patent No.: US 6,398,699 B1
(45) Date of Patent: Jun. 4, 2002

(54) EXERCISE MACHINE

(75) Inventor: Hsin-Yen Yang, Taichung Hsien (TW)

(73) Assignee: Uniasso Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/957,604

(22) Filed: Sep. 21, 2001

(51) Int. Cl.[7] ..... A63B 21/04
(52) U.S. Cl. ..... 482/142; 482/146; 482/52
(58) Field of Search ..... 482/51, 57, 121, 482/122, 123, 133, 92, 142, 146, 148, 907, 140, 52, 130

*Primary Examiner*—Stephen R. Crow
(74) *Attorney, Agent, or Firm*—Harrison & Egbert

(57) ABSTRACT

An exercise machine includes a base on which a swiveling frame is pivotally mounted. The swiveling frame is provided at one end with a seat, and at another end with a leg-supporting frame pivoted therewith by a position controlling seat. The base is further provided with a backrest frame pivoted therewith by an adjustment seat. The leg-supporting frame and the backrest frame can be adjusted to be positioned at a specific angular position so as to provide a user of the exercise machine with the damping force of a desired magnitude.

1 Claim, 8 Drawing Sheets

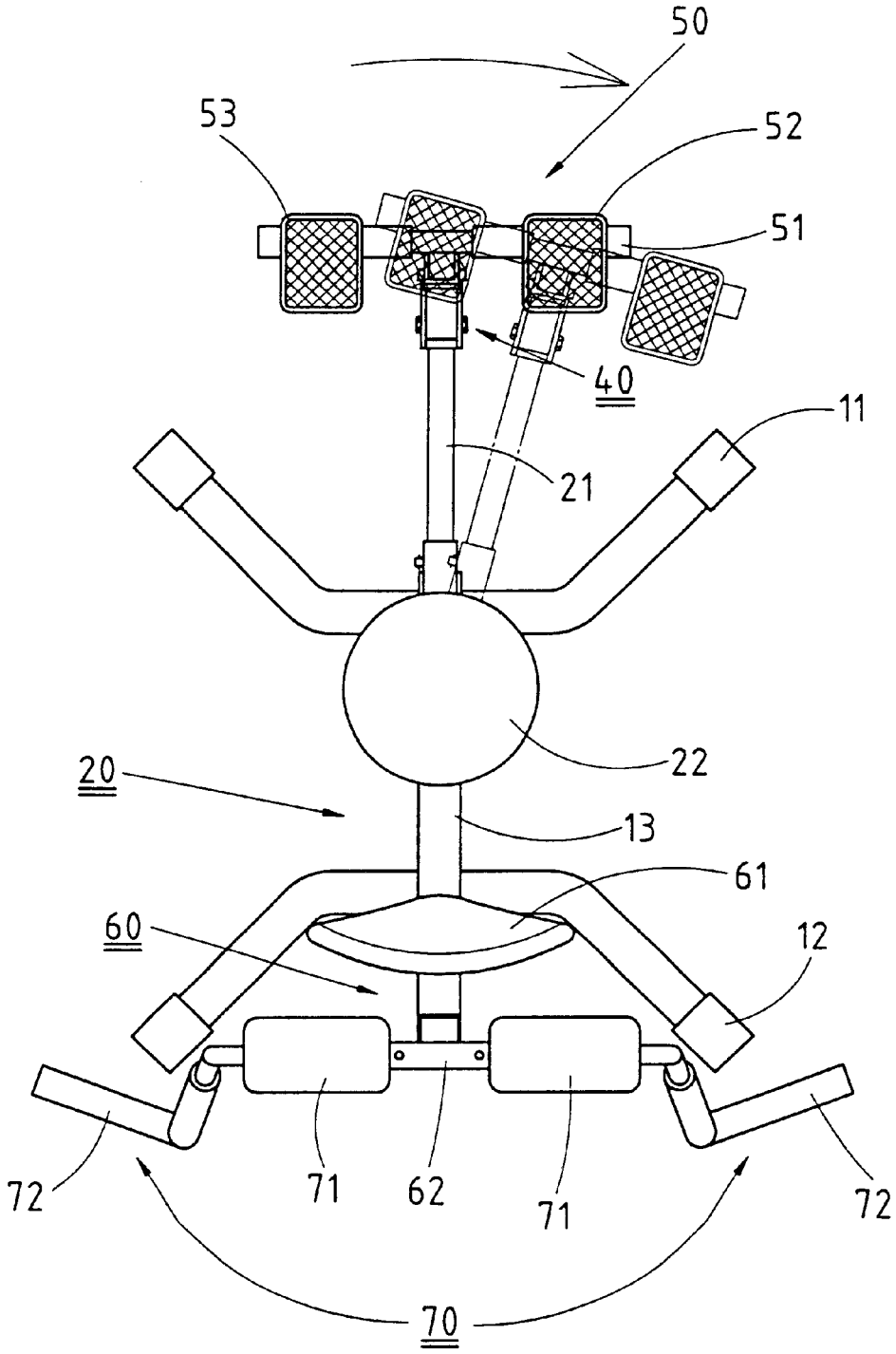
FIG.5-A

EXERCISE MACHINE

BACKGROUND OF THE INVENTION

1. Field of the Invention

The present invention relates to an exercise machine which is designed for use in training various parts of the body of an exerciser.

2. Description of Related Art

The conventional exercise device is generally designed to train a specific part of the body of an exerciser and is therefore not suitable for use in training various parts of the exerciser's body. In addition, the conventional exercise device is generally not provided with a device for adjusting the magnitude of the damping force. Even if the conventional exercise device is provided with such a device, the device is complicated in construction and is not cost-effective.

BRIEF SUMMARY OF THE INVENTION

The primary objective of the present invention is to provide an exercise machine which is versatile and cost-effective.

The exercise machine of the present invention comprises a base on which a swiveling frame is pivotally mounted. The swiveling frame is provided at one end with a seat, and at the other end with a leg-supporting frame. The base is further provided with a backrest opposite in location to the leg-supporting frame. The backrest is provided with two handles pivoted therewith. The backrest and the leg-supporting frame can be adjusted to be positioned at a specific angular position so as to provide an exerciser with the damping force of a desired magnitude.

The features and the advantages of the exercise machine of the present invention will be more readily understood upon a thoughtful deliberation of the following detailed description of a preferred embodiment of the present invention with reference to the accompanying drawings.

BRIEF DESCRIPTION OF THE SEVERAL VIEWS OF THE DRAWINGS

FIG. 5A shows another top plan view of the swiveling frame of the preferred embodiment of the present invention in action.

DETAILED DESCRIPTION OF THE INVENTION

Figure 1:
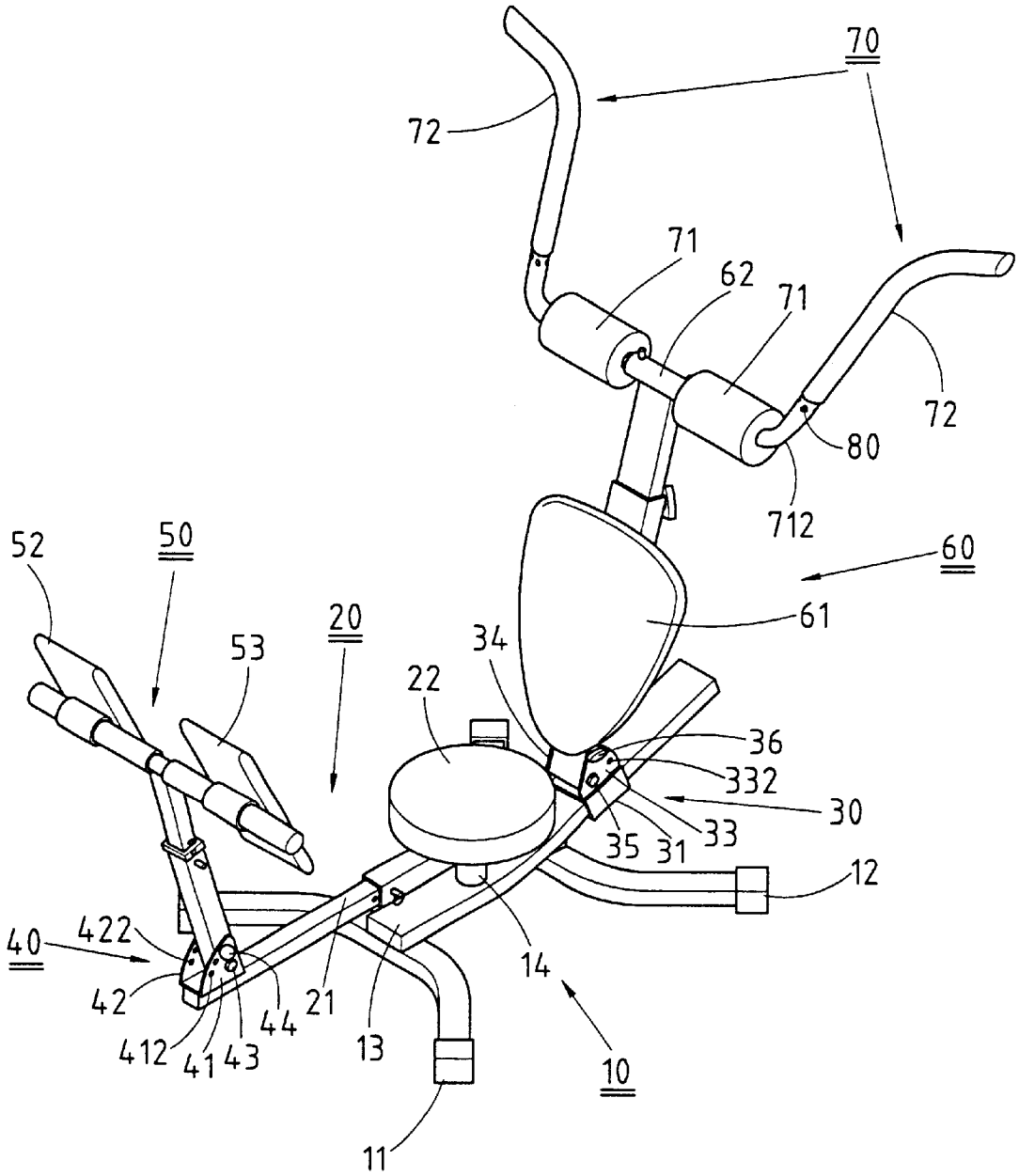
FIG. 1 shows a perspective view of the preferred embodiment of the present invention.
Figure 2:
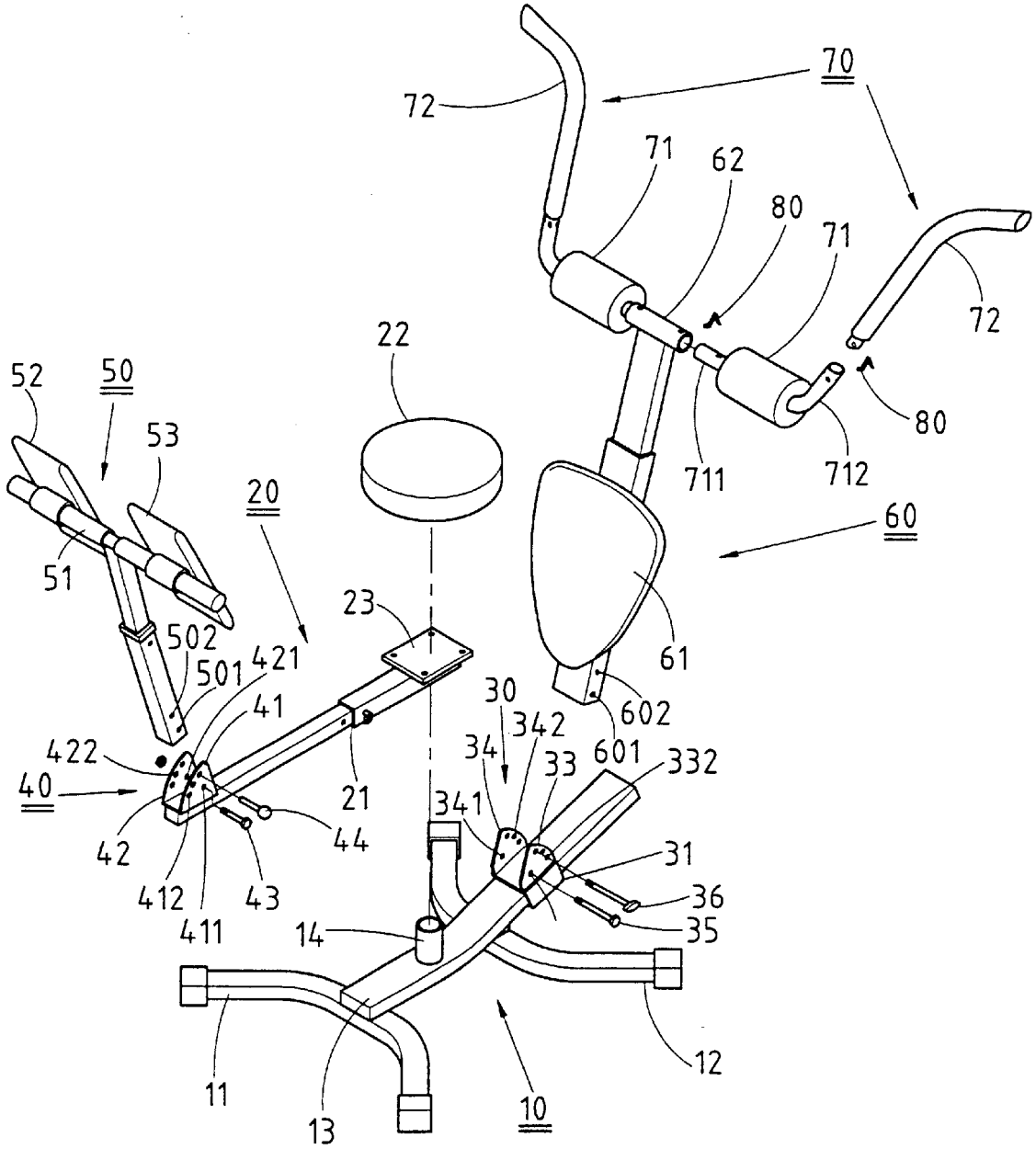
FIG. 2 shows an exploded view of the preferred embodiment of the present invention.
Figure 3:
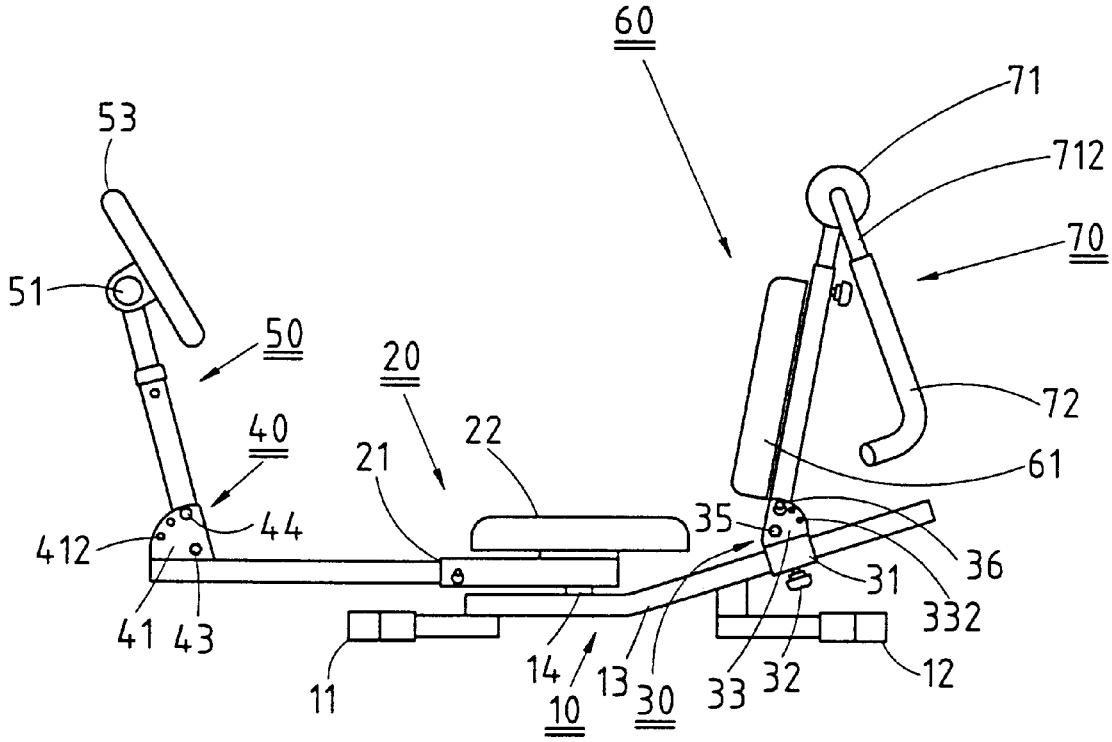
FIG. 3 shows a side plan view of the preferred embodiment of the present invention.

As shown in FIGS. 1–3, an exercise machine embodied in the present invention comprises the component parts which are described hereinafter.

A base 10 is formed of a first bottom frame 11, a second bottom frame 12, and a base rod 13 mounted on the bottom frames 11 and 12. The base rod 13 is provided with a shaft tube 14 and an adjustment seat 30.

A swiveling frame 20 is formed of an arresting rod 21 and a seat-supporting plate 23 on which a seat pad 22 is disposed. The underside of the seat-supporting plate 23 is pivoted with the shaft tube 14 of the base 10. The swiveling frame 20 is further formed of a position controlling seat 40 which is opposite in location to the seat-supporting plate 23 and the adjustment seat 30.

A leg-supporting frame 50 is fastened at the bottom end to the position-controlling seat 40 and is provided at the top end with a cross rod 51, and two pedals 52 and 53 which are pivotally mounted on two opposite ends of the cross rod 51.

A backrest frame 60 is provided with a backrest pad 61 and is fastened at the bottom end with the adjustment seat 30. The backrest frame 60 is further provided at the top end with a cross shaft tube 62.

Two handle frames 70 are identical in construction to each other and are formed of a rest pad 71 and a grip 72. The rest pad 71 is provided at two ends thereof with connection tubes 711 and 712, with each being provided in the interior thereof with a retaining piece 80 to facilitate the pivoting of the first connection tube 711 with two ends of the cross shaft tube 62 of the backrest frame 60.

The second connection tube 712 of the rest pad 71 is pivoted with one end of the grip 72 in conjunction with the retaining piece 80.

The present invention is characterized by the adjustment seat 30 and the position controlling seat 40.

The adjustment seat 30 has a fitting portion 31, which is fitted over one end of the base rod 13 of the base 10 in conjunction with a locating button 32 for locating the fitting portion 31 on the base rod 13. The fitting portion 31 is provided with a first upright plate 33 and a second upright plate 34, which are respectively provided with a pivoting hole 331, 341, and a plurality of fastening holes 332, 342. The backrest frame 60 and the base rod 13 of the base 10 are pivoted together by a pivot 35 which is put through the pivoting hole 331 of the first upright plate 33, the pivoting hole 341 of the second upright plate 34, and a first connection hole 601 of the bottom end of the backrest frame 60. A fastening bolt 36 is put through one of the fastening holes 332 of the first upright plate 33, one of the fastening holes 342 of the second upright plate 34, and a second connection hole 602 of the bottom end of the backrest frame 60. As a result, the backrest frame 60 is fastened fixedly with the base rod 13 of the base 10.

The position controlling seat 40 is provided with a first side plate 41 and a second side plate 42, which are opposite in location to each other. The first side plate. 41 is provided with a first pivoting hole 411 and a plurality of fastening holes 412. The second side plate 42 is provided with a second pivoting hole 421 and a plurality of fastening hole 422. The bottom end of the leg-supporting frame 50 is pivoted with the arresting rod 21 of the swiveling frame 20 by a pivot 43 which is received in the pivoting holes 411 and 421 of the two side plates 41 and 42, as well as a first through hole 501 of the bottom end of the leg-supporting frame 50. The leg-supporting frame 50 and the arresting rod 21 of the swiveling frame 20 are fastened fixedly by a fastening bolt 44 which is received in one of the fastening holes 412 of the first side plate 41, one of the fastening holes 422 of the second side plate 42, and a second through hole 502 of the bottom end of the leg-supporting frame 50.

Figure 4:
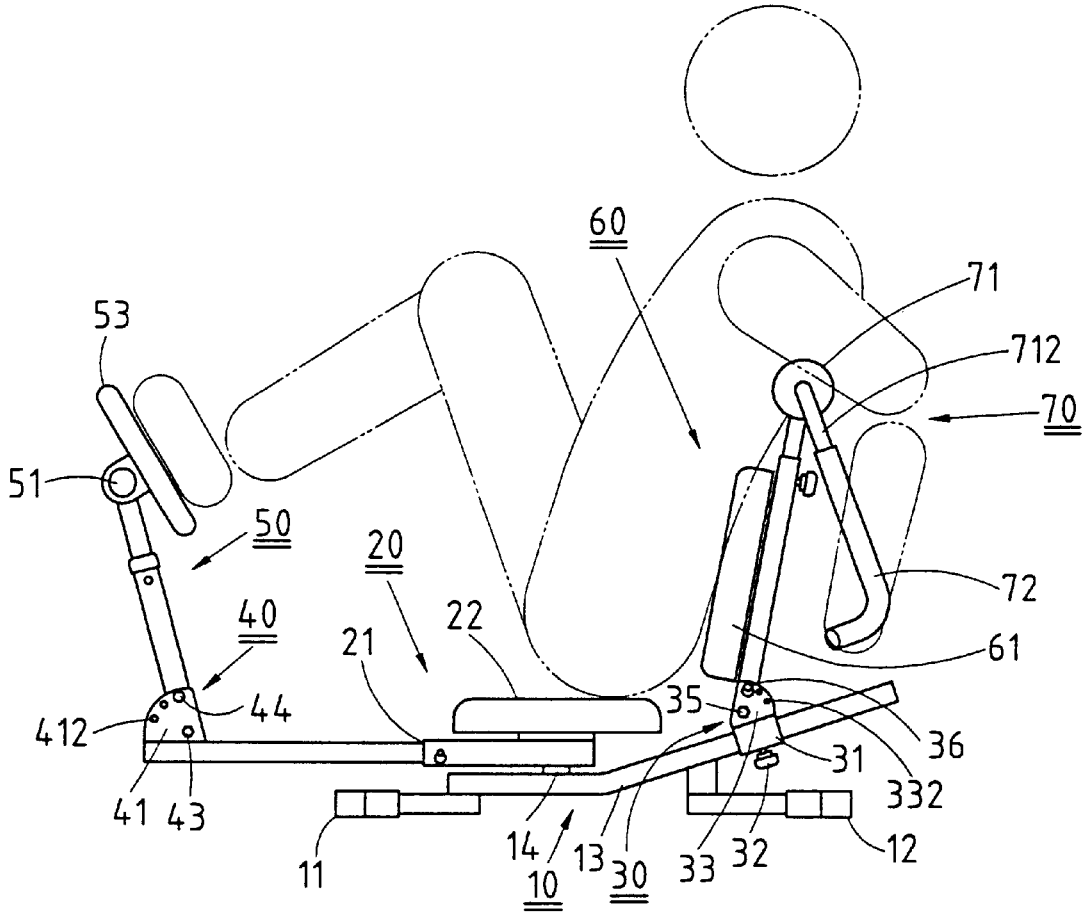
FIG. 4 shows a schematic view of the preferred embodiment of the present invention in a first form of operation.
Figure 5:
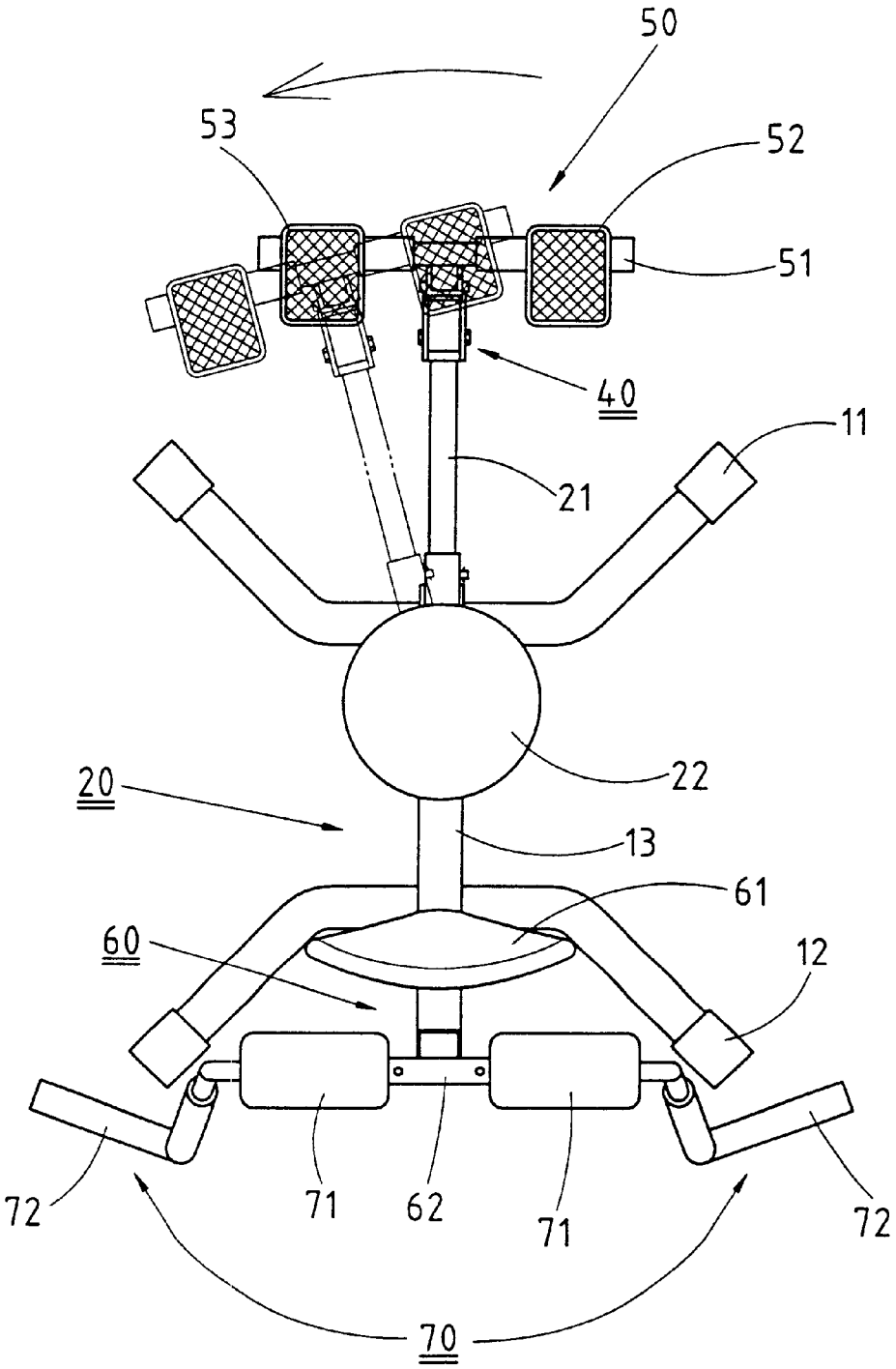
FIG. 5 shows a top plan view of the swiveling frame of the preferred embodiment of the present invention in action.

As illustrated in FIG. 4, an exerciser is seated on the seat pad 22 such that both hands of the exerciser hold the grips 72, and that the back of the exerciser is rested against the backrest 61, and further that both feet of the exerciser are rested against the pedals 52 and 53. As illustrated in FIGS. 5 and 5A, when the two pedals 52 and 53 are moved leftwards and rightwards in a reciprocating manner, the swiveling frame 20 is caused to swivel leftwards and rightwards in the reciprocating manner. As a result, the exercise effect is brought about on the belly, the legs, the waist, and the hips of the exerciser.

Figure 6:
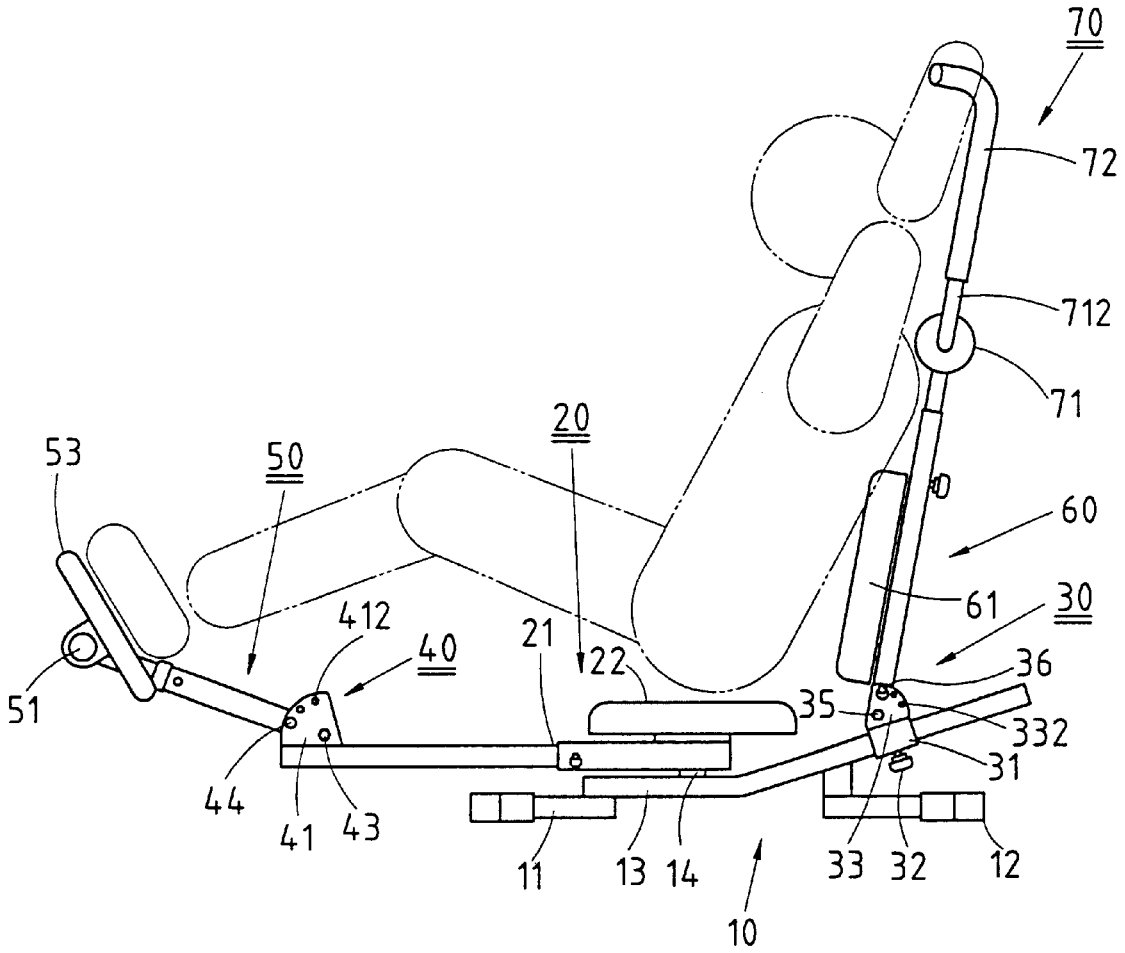
FIG. 6 shows a schematic view of the preferred embodiment of the present invention in a second form of operation.

As illustrated in FIG. 6 in conjunction with FIGS. 4, 5, and 5A, the leg-supporting frame 50 can be angularly relocated by inserting the fastening bolt 44 into other fastening holes 412 and 422 of the position controlling seat 40, thereby enabling both legs of the exerciser to extend. As a result, both legs of the exerciser must exert a greater force on the pedals 52 and 53 so as to cause the two pedals 52 and 53 to move leftward and rightward in the reciprocating manner. In other words, a greater damping force is thus provided by the exercise machine of the present invention by adjusting the angular position of the leg-supporting frame 50.

Figure 7:
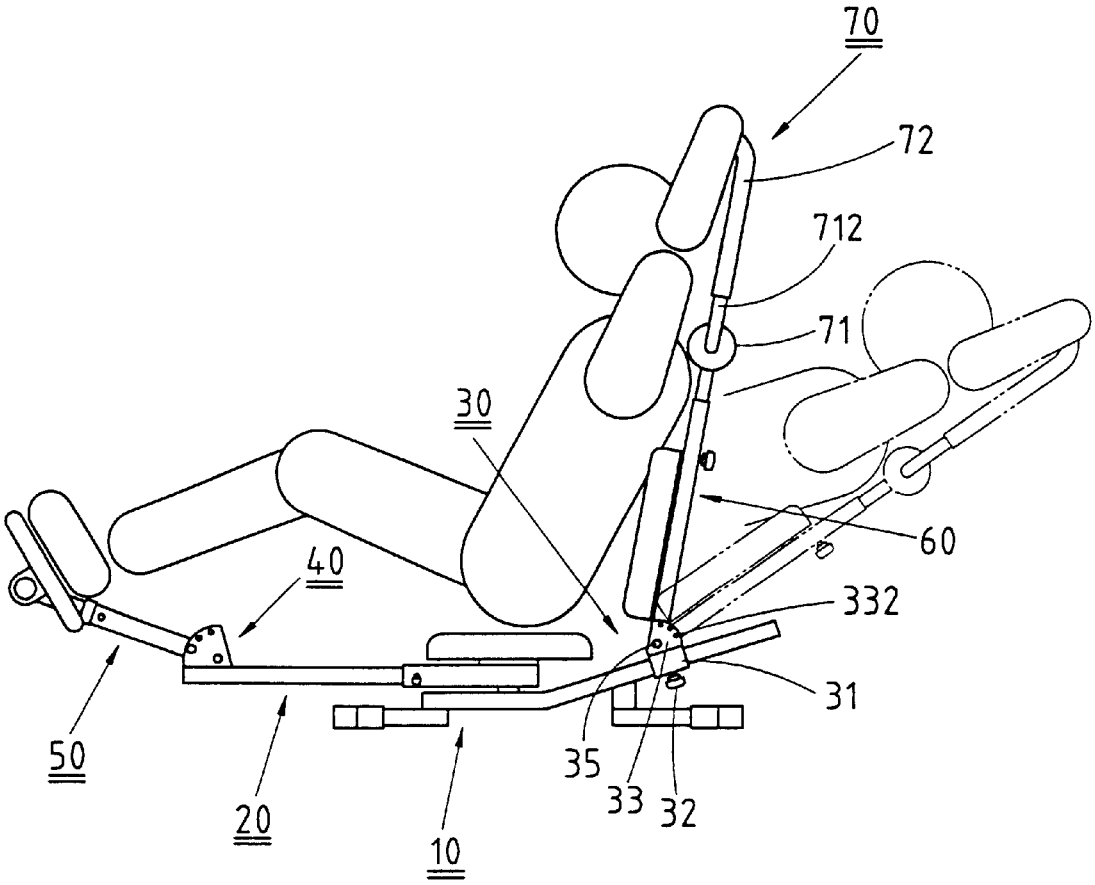
FIG. 7 shows a schematic view of the preferred embodiment of the present invention in a third form of operation.

As illustrated in FIG. 7, the backrest frame 60 is reclined by inserting the fastening bolt 36 into other fastening holes 332 and 342 of the adjustment seat 30. The belly muscles of an exerciser are trained when the upper portion of the body of the exerciser moves away from and towards the reclined backrest frame 60 in a reciprocating manner.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claim.

I claim:

1. An exercise machine comprising:

a base comprised of a first bottom frame, a second bottom frame, and a base rod mounted on said first bottom frame and said second bottom frame, said base rod comprised of a shaft tube fastened thereto, said base rod further comprised of an adjustment seat fastened thereto;

a swiveling frame comprised of an arresting rod and a seat-supporting plate on which a seat pad is disposed, said seat-supporting plate being pivoted with said shaft tube of said base rod of said base, said swiveling frame comprised of a position controlling seat fastened thereto such that said position controlling seat is opposite in location to said seat-supporting plate;

a leg-supporting frame fastened pivotally at a bottom end to said swiveling frame by said position controlling seat, said leg-supporting frame being provided at a top end with a cross rod, and two pedals pivoted to two ends of said cross rod;

a backrest frame comprised of a backrest pad and fastened pivotally at a bottom end to said base rod of said base by said adjustment seat, said backrest frame further provided at a top end to a cross shaft tube; and two handle frames, with each being comprised of a rest pad and a hand grip, said rest pad being pivoted at one end with said cross shaft tube and at another end with said hand grip;

wherein said adjustment seat is comprised of a first upright plate, a second upright plate, and a fitting portion which is fitted over said base rod of said base, said first upright plate comprised of a first pivoting hole and a plurality of first fastening holes, said second upright plate comprised of a second pivoting hole and a plurality of second fastening holes; wherein said bottom end of said backrest frame is comprised of a first connection hole and a second connection hole whereby said backrest frame is fastened pivotally to said base rod of said base by a pivot which is put through said first pivoting hole of said first upright plate, said second pivoting hole of said second upright plate, and said first connection hole of said backrest frame, said backrest frame capable of being fastened fixedly to said base rod of said base by a fastening bolt which is put through one of said first fastening holes of said first upright plate, one of said second fastening holes of said second upright plate, and said second connection hole of said bottom end of said backrest frame;

wherein said position controlling seat is comprised of a first side plate and a second side plate, said first side plate being comprised of a first pivoting hole and a plurality of first fastening holes, said second side plate being comprised of a second pivoting hole and a plurality of second fastening holes; wherein said bottom end of said leg-supporting frame is provided with a first through hole and a second through hole whereby said leg-supporting frame is fastened pivotally to said swiveling frame by a pivot which is received in said first pivoting hole of said first side plate, said second pivoting hole of said second side plate, and said first through hole of said bottom end of said leg-supporting frame, said leg-supporting frame capable of being fastened fixedly with said swiveling frame by a fastening bolt which is received in one of said first fastening holes of said first side plate, one of said second fastening holes of said second side plate, and said second through hole of said bottom end of said leg-supporting frame.

* * * * *